US007270323B2

(12) United States Patent
Somemiya

(10) Patent No.: US 7,270,323 B2
(45) Date of Patent: Sep. 18, 2007

(54) SHEET FEEDING DEVICE WITH TWO CAMS

(75) Inventor: Tsutomu Somemiya, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 463 days.

(21) Appl. No.: 10/865,905

(22) Filed: Jun. 14, 2004

(65) Prior Publication Data

US 2005/0189698 A1 Sep. 1, 2005

(30) Foreign Application Priority Data

Nov. 26, 2003 (JP) ..... P2003-395636

(51) Int. Cl.
*B65H 3/24* (2006.01)

(52) U.S. Cl. ..... 271/127; 271/114

(58) Field of Classification Search ..... 271/109, 271/114, 117, 118, 126, 157, 127
See application file for complete search history.

(56) References Cited

U.S. PATENT DOCUMENTS 4,223,993 A * 9/1980 Tsuda et al. ..... 399/398
5,201,873 A * 4/1993 Kikuchi et al. ..... 271/9.13
5,895,038 A * 4/1999 Takashima ..... 271/114
6,056,285 A * 5/2000 Kikuta et al. ..... 271/118
6,070,867 A * 6/2000 Tsurumi et al. ..... 271/114

FOREIGN PATENT DOCUMENTS

JP A-01-308339 12/1989
JP 02193830 A * 7/1990
JP A-08-268574 10/1996
JP A-09-188423 7/1997
JP 09278205 A * 10/1997
JP A-11-130276 5/1999
JP A-2000-136035 5/2000
JP 2002-128286 5/2002
JP 2002128286 A * 5/2002

* cited by examiner

*Primary Examiner*—Patrick Mackey
*Assistant Examiner*—Michael C McCullough
(74) *Attorney, Agent, or Firm*—Morgan, Lewis & Bockius LLP

(57) ABSTRACT

A sheet supplying/feeding device includes a sheet placing plate that receives at least a tip of a sheet, a feeding unit that feeds the sheet while being in contact with the sheet placed on the sheet placing plate, and a driving unit that drives the feeding unit. Preferably, cam members are provided at both ends of a rotating shaft of the feeding unit, displacement changing members are swingably provided in engagement with the cam members, the sheet placing plate is shifted synchronously with the swing of the displacement changing members through first elastic members, and the sheet placed on the sheet placing plate and the feeding unit are contacted and separated by the synchronous movement of the sheet placing plate and the displacement changing members.

22 Claims, 10 Drawing Sheets

SHEET FEEDING DEVICE WITH TWO CAMS

BACKGROUND OF THE INVENTION

1. Field of the Invention

This invention relates to a sheet supplying/feeding device which is employed in an imaging device such as a copier, printer, facsimile or a composite machine of these devices using electrophotography, and more particularly to a sheet supplying/feeding device which can supply/feed a sheet stably and intermittently with no adverse effect and occurrence of impact sound due to shock during supplying/feeding of the sheet.

2. Description of the Related Art

Traditionally, in an imaging device such as a copier, printer, facsimile or a composite machine of these devices using electrophotography, such a configuration as shown in FIG. 12 has been mainly employed as a sheet hand-supplying/feeding device. This sheet supplying/feeding device 100, as seen from FIG. 12, is provided with a pressing plate 101 on which a sheet (not shown) is placed. This pressing plate 101 is urged upward by a coil spring 102. Above the pressing plate 101, a rotating shaft 103, which is journaled on a bearing of a device body (not shown), is arranged. Crescent-shaped supplying/feeding rolls 104 for supplying/feeding the sheet are fixed to the rotating shaft 103. Core rolls 105 for determining the uppermost stage of the sheet are also rotatably journaled on the rotating shaft 103.

Cam plates 106 are fixed to both ends of the rotating shaft 103, respectively. While the sheet is not supplied/fed, the cam plates 106 depress flanges 107, respectively so that the sheet (not shown) placed on the pressing plate 101 is separated from the supplying/feeding rolls 104.

Meanwhile, the above conventional sheet supplying/feeding 100 has the following problems:

(1) An adverse effect on image quality is generated owing to shock, and the impact sound is also loud.

(2) The intermittent driving of the supplying/feeding rolls 104 which serve as feeding units is likely to be unstable (the rolls do not rotate or continue to rotate).

The problem of (1) is attributed to the following fact. As seen from FIG. 12, when the cam plates 106 are released, the pressing plate 101 with the sheet placed thereon, which has been depressed by the cam plates 106, is rebounded upward owing to the urging force of the coil spring 102. Then, the sheet hits against the supplying/feeding rolls 100. In the case of continuous supplying/feeding, the shock at this instant when the sheet hits against the supplying/feeding rolls 100 has an adverse effect on the image quality of the sheet in printing which has been supplied/fed just before. The impact sound at this time is also loud.

On the other hand, the problem of (2) is particularly remarkable when a tooth-lack gear 108 is employed, as shown in FIG. 12, as an intermittent driving unit for intermittently driving the supplying/feeding rolls 104 which is the feeding unit. In many cases, in order to meet the demand of cost reduction, recent imaging devices such as a printer employ the tooth-lack gear in place of a spring clutch as the intermittent driving unit for intermittently driving the supplying/feeding rolls 104. The spring clutch, in which gears always in mesh with each other, facilitates coupling/release of driving. On the other hand, where the tooth-lack gear 108 is employed, the gear 108 must be rotated until it meshes with an idler gear 109. The rotating force is generated by the elastic member such as a coil spring 110 attached to the tooth-lack gear 108. Further, the cam plates 106 serving to make the contact/separation of the pressing plate 101 for the supplying/feeding rolls 104 are attached to the rotating shaft 103 of the supplying/feeding rolls 104 which are the feeding units. In a stand-by state, the coil spring 102 which is an urging unit for the pressing plate 101 is in a state where it is compressed to the maximum with strong urging force. Therefore, where the rotating shaft 103 of the supplying/feeding rolls 104 is operated from the stand-by state, very large resistance is generated between the cam plates 106 and the flanges 107 so that the force of the coil spring 110 for the tooth-lack gear 108 must be set at a large magnitude. If this force is too great, the lug (not shown) attached to the tooth-lack gear 108 is likely to be released from a solenoid 111. As a result, the supplying/feeding rolls 104 are not rotated intermittently but rotated continuously. Accordingly, a sheet of paper is not supplied at regular intervals. This leads to paper jamming.

On the other hand, if the force of the coil spring 110 for the tooth-lack 108 is too small, even when the solenoid 111 is operated, the tooth-lack gear 108 starts to operate with a time lag, or otherwise does not rotate. As the case may be, this leads to an inconvenience of causing the shifting of the position where an image is started to be written or paper jamming. Incidentally, a configuration has been also proposed in which pressing force of a separating member acts on the rotating shaft 103 of the supplying/feeding rolls 104. However, the pressing force is smaller than that of the urging member for the pressing plate 101.

Examples of the techniques capable of solving the above problems have been disclosed in JP-A-2000-136035, JP-A-1-308339 or JP-A-8-268574.

SUMMARY OF THE INVENTION

However, the above related arts have the following problems.

In order to obviate the problem of (1), a sheet supplying/feeding device as disclosed in JP-A-2000-136035 has been proposed. The sheet supplying/feeding device as disclosed in JP-A-2000-136035, however, is provided with a restricting unit for restricting the rebounding speed of the pressing plate after the pressing unit has released the pressing force. This makes the structure complicated and requires a large space where the restricting unit is to be arranged, thereby leading to an increase in the production cost and upsizing of the device.

On the other hand, the hand sheet-feeding device disclosed in JP-A-1-308339 is structured so that in the stand-by state, the urging unit for the sheet placing plate provides the weakest force, and when the paper supplying operation is started, the urging force increases.

The hand sheet-feeding device disclosed in JP-A-1-308339 can improve the above problems of (1) and (2). This device, however, has the problems that driving of the feeding unit must be controlled separately, and the urging force is unstable under the influence of twisting due to the sheet placing plate being urged by the elastic member on the one side.

The sheet supplying/feeding device disclosed in JP-A-8-268574 is provided with a sheet bundle receiving member and a pressurizing mechanism of pressurizing the sheet receiving member toward the supplying/feeding roll through a spring member synchronously with the rotating operation of the supplying/feeding roll on the lower side of the tip of the sheet bundle. Since the sheet receiving member and the pressurizing mechanism are provided on the lower side of the tip of the sheet bundle, the pressurizing mechanism must be arranged centrally beneath the sheet bundle receiving member. This leads to the other problems of upsizing of each member and complication of the structure of the device.

This invention has been accomplished in order to obviate the problems of the related arts. The present invention has been made in view of the above circumstances and provides a sheet supplying/feeding device which can supply/feed a sheet stably and intermittently while preventing an adverse effect and occurrence of impact sound due to shock during supplying/feeding of the sheet, without giving rise to upsizing components and complication of the structure.

According to an aspect of the present invention, a sheet supplying/feeding device includes a sheet placing plate that places at least a tip of a sheet, a feeding unit that feeds the sheet while being in contact with the sheet placed on the sheet placing plate, and a driving unit that drives the feeding unit. Preferably, cam members are provided at both ends of a rotating shaft of the feeding unit, displacement changing members are swingably provided in engagement with the cam members, the sheet placing plate is shifted synchronously with the swing of the displacement changing members through first elastic members, and the sheet placed on the sheet placing plate and the feeding unit are contacted and separated by the synchronous movement.

In accordance with the invention, cam members attached to both ends of the rotating shaft which rotates the feeding unit rotate synchronously with the start of the rotation of the feeding unit, and the displacement changing members swing with the rotation of the cam members. Attendant on the swing of the displacement changing members the sheet placing plate shifts upwards through the first elastic members. The urging force gradually increases with the extension of the first elastic members due to the swing of the displacement changing members. Therefore, in such a simple configuration, the shock and impact sound at the instant when the sheet touches with the feeding unit can be reduced. Further, since the sheet placing plate is urged at its both ends by the cam members and the displacement changing members provided at both ends of the rotating shaft which rotates the feeding unit, the sheet can be supplied/fed with a preferred supplying/feeding performance without being affected by the twist of the sheet placing plate. Since it is not necessary to arrange the urging member at the center of the sheet placing plate, the sheet supplying/feeding device can be provided in a compact structure.

In accordance with this invention, there can be provided a sheet supplying/feeding device which can supply/feed a sheet stably and intermittently while preventing an adverse effect and occurrence of impact sound due to shock during supplying/feeding of the sheet, without giving rise to upsizing components and complication of the structure of the device.

BRIEF DESCRIPTION OF THE DRAWINGS

Preferred embodiment of the present invention will be described in detail based on the following figures, wherein.

DETAILED DESCRIPTION OF THE INVENTION

Figure 1:
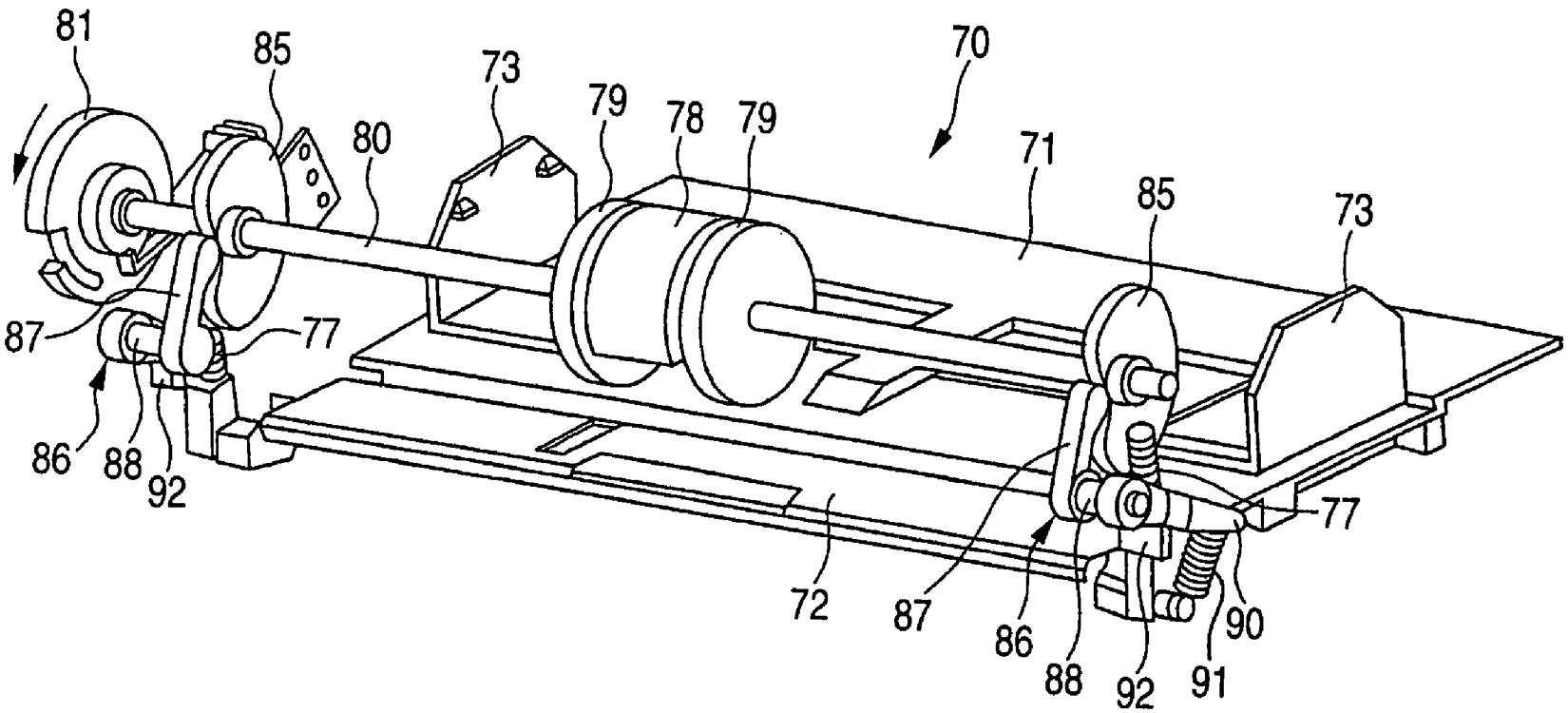
FIG. 1 is a perspective view showing a sheet supplying/feeding device according to a first embodiment of this invention.

Referring now to the drawings, an explanation will be given of various embodiments of this invention.

Figure 2:
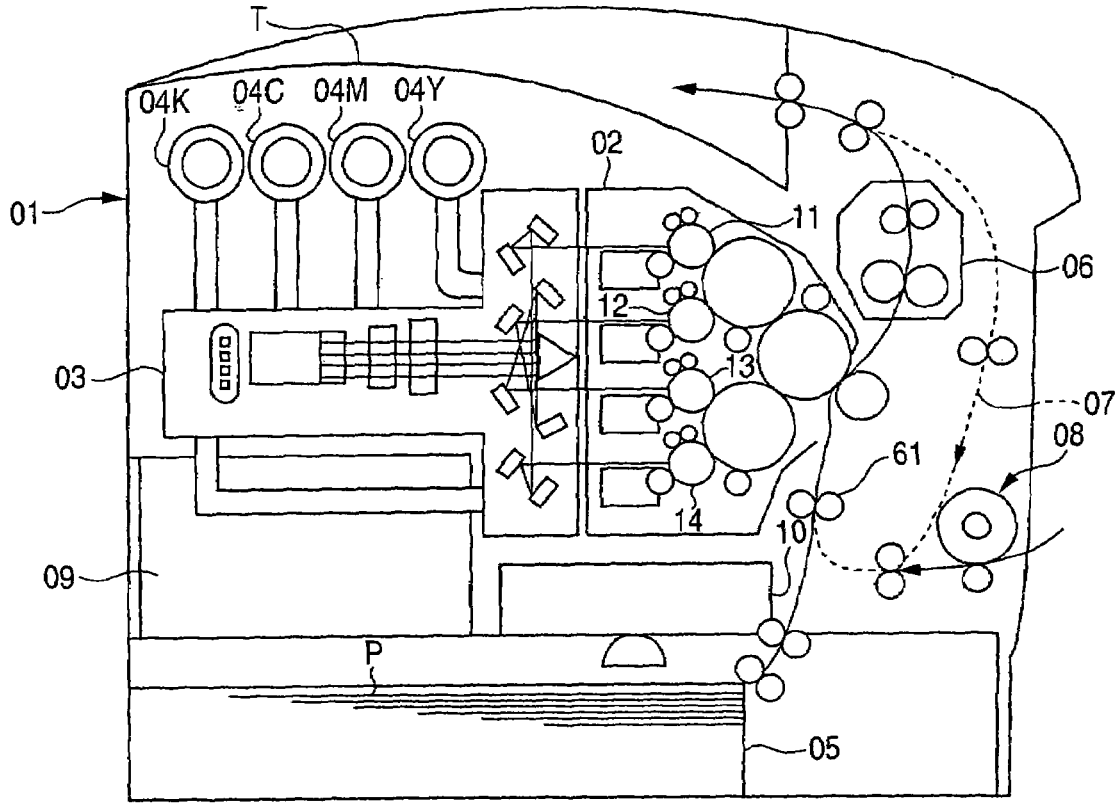
FIG. 2 is a view showing the structure of a full-color printer, which is an imaging device with which the sheet supplying/feeding device according to the first embodiment of this invention is used.
Figure 3:
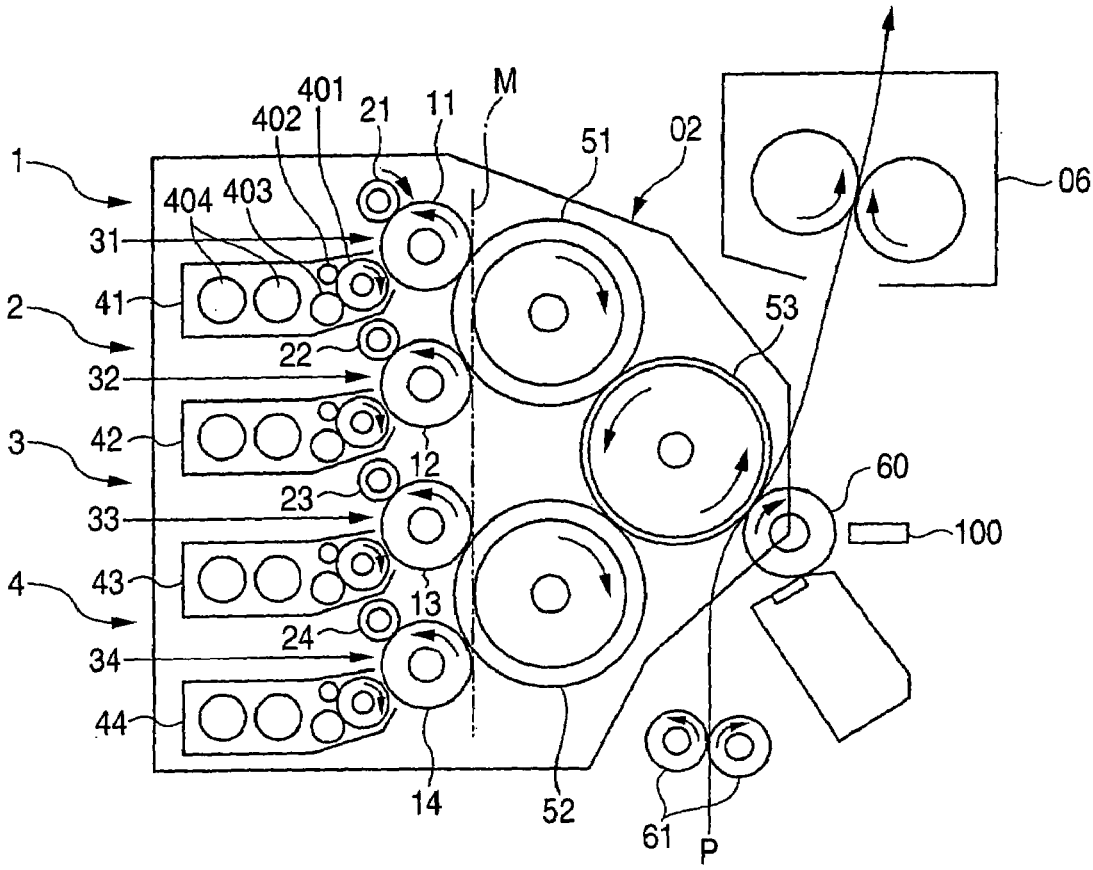
FIG. 3 is a view showing the structure of an imaging section of a full-color printer, which is an imaging apparatus with which the sheet supplying/feeding device according to the first embodiment of this invention is used.

FIGS. 2 and 3 show a tandem type full-color printer which is an imaging device to which the sheet supplying/feeding device according to the first embodiment of this invention is applied. Incidentally, arrows in FIG. 3 indicate the rotating direction of each roller.

A full-color printer, generally 01, as seen from FIGS. 2 and 3, includes main components of imaging units 1, 2, 3 and 4 having the corresponding photoconductor drums (image carriers) 11, 12, 13 and 14 for yellow (Y), magenta (M), cyan (C) and black (K); charging rolls (contact type charging devices) 21, 22, 23 and 24 for primary charging in contact with these photoconductor drums 11, 12, 13 and 14; a laser optical unit 03 (exposure device) shown in FIG. 2 for projecting laser beams 31, 32, 33 and 34 of the respective colors of yellow (Y), magenta (M), cyan (C) and black (K); developers 41, 42, 43 and 44; a first primary intermediate duplicating drum (intermediate duplicator) 51 in contact with the two photoconductor drums 11 and 12 of the four photoconductor drums 11, 12, 13 and 14 and a second primary intermediate duplicating drum (intermediate duplicator) 52 in contact with the other two photoconductor drums 13 and 14; a secondary intermediate duplicating drum (intermediate duplicator) 53 in contact with the first and second primary duplicating drums 51 and 52; a duplicating roll (duplicating member) 60 in contact with the secondary intermediate duplicating drum 53.

The photoconductor drums 11, 12, 13 and 14, as seen from FIG. 3, are arranged with regular intervals so as to have a common contact plane M. The first intermediate duplicating drum 51 and second intermediate duplicating drum 52 are arranged so that their rotating axes are in parallel to those of the photoconductor drums 11, 12, 13 and 14 and symmetric with respect to a predetermined objective plane. Further, the second intermediate duplicating drum 53 is arranged so that its rotating axis is in parallel to those of the photoconductor drums 11, 12, 13 and 14.

The signal corresponding to the image information for each color is rastererized by an image processing unit (not shown) and supplied to the laser optical unit 03 shown in FIG. 2. In the laser optical unit 03, the laser beams 31, 32, 33 and 34 of the respective colors of yellow (Y), magenta (M), cyan (C) and black (K) are modulated and projected to the corresponding color photoconductor drums 11, 12, 13 and 14.

In the vicinity of each photoconductor drum 11, 12, 13, 14, the imaging process for each color based on the known electrophotography is carried out. First, as the photoconductor drum 11, 12, 13, 14, for example, a photoconductor drum (image carrier) using an OPC photoconductor having a diameter of 20 mm is used. These photoconductor drums 11, 12, 13 and 14 are rotation-driven at a rotating speed of e.g. 95 mm/sec. As seen from FIG. 3, the surface of each photoconductor drum 11, 12, 13, 14 is charged at e.g. about −300 V by applying a DC voltage of about −840 V to the charging roll 21, 22, 23, 24 serving as the contact charging device. Incidentally, the contact charging device may be any type including a roll type, film type, brush type, etc. In this embodiment, a charging roll, which has been generally employed in the electrophotographic device in recent years, is adopted. In order to charge the surface of the photoconductor drum 11, 12, 13, 14, in this embodiment, the charging system of applying only the DC voltage is adopted. However, the charging system of applying both the AC voltage and DC voltage may be adopted.

Thereafter, the surface of the photoconductor drum 11, 12, 13, 14 is irradiated with the laser beam 31, 32, 33, 34 corresponding to the yellow (Y), magenta (M), cyan (C), black (K) by the laser optical unit 03 which is the exposure device. Thus, the electrostatic latent image corresponding to the input image information for each color is created on the surface. When the latent image is written by the laser optical unit, in the photoconductor drum 11, 12, 13, 14, the surface is discharged to about −60 V or lower at the potential of the image exposed portion.

The electrostatic latent image corresponding to each color of yellow (Y), magenta (M), cyan (C), black (K) created on the surface of the photoconductor drum 11, 12, 13, 14 is developed by the corresponding color developer 41, 42, 43, 44. The electrostatic latent image thus developed is visualized as the toner image of each color of yellow (Y), magenta (M), cyan (C), black (K) on the photoconductor drum 11, 12, 13, 14.

In this embodiment, the developing device 41, 42, 43, 44 adopts a magnetic brush contact type of two-component developing system, but the scope of the invention should not be limited to such a developing system. This invention can be adequately applied to the other developing system such as a single-component developing system, a non-contact type developing system, etc.

The developing device 41, 42, 43, 44 is filled with a toner of each color of yellow (Y), magenta (M), cyan (C), black (K) and a developer of carriers. When the developing device 41, 42, 43, 44 is supplied with the corresponding toner from a cartridge 04Y, 04M, 04C, 04K shown in FIG. 2, the toner thus supplied is sufficiently stirred with the carriers by an auger 404 so that it is frictionally charged. Within a developing roll 401, a magnet roll (not shown) with plural magnetic poles located at a prescribed angle is fixedly arranged. A paddle 403 transfers the developer toward the developing roll 401. The developer transferred to the vicinity of the surface of the developing roll 401 by the paddle 403 is limited in its quantity transferred to the developing portion by a developer quantity controlling member 402. In this embodiment, the quantity of the developer is set at 30 to 50 g/m$^2$, and the charged quantity of the toner existing on the developing roll 401 is about −20 to 35 μC/g.

The toner employed in the developing device 41, 42, 43, 44 may be a "spherical toner" with a form factor MLS2 defined by the following equation being 100 to 140, e.g. MLS2=about 130 and an average grain diameter of 3 μm to 10 μm.

$$MLS2 = \{(\text{absolute maximum length of the toner particle}) \times 2\} / \{(\text{projected area of the toner particle}) \times \pi \times 1/4 \times 100\}$$

The toner supplied onto the developing roll 401 forms a magnetic brush with the carriers owing to a magnetic force of the magnet roll. The magnetic brush is in contact with the photoconductor drum 11, 12, 13, 14. By applying a developing bias voltage of AC+DC to the developing roll 401 so that the toner on the developing roll 401 is developed as a latent image created on the photoconductor drum 11, 12, 13, 14, the toner image is created. In this embodiment, the developing bias voltage is set at 4 kHz, 1.5 kVpp in AC and about −230V in DC.

The toner image of each color of yellow (Y), magenta (M), cyan (C), black (K) created on the photoconductor drum 11, 12, 13, 14 is primarily electrostatic-duplicated on the first primary duplicating drum 51 and the second primary duplicating drum 52. Specifically, the toner images of yellow (Y) and magenta (M) created on the photoconductor drums 11 and 12 are duplicated on the first primary intermediate duplicating drum 51, respectively. The toner images of cyan (C) and black (K) are duplicated on the second primary intermediate duplicating drum 52, respectively. Thus, on the first primary intermediate duplicating drum 51, created are a monochromatic image duplicated from either the photoconductor drum 11 or 12 and a double-color image composed of two-color toner images superposition-duplicated from both the photoconductor drums 11 and 12. On the second primary intermediate drum 52 also, likewise, the monochromatic image and double-color image are created.

The surface potential required to duplicate electrostatically the toner image from the photoconductor drum 11, 12, 13, 14 to the first and second primary duplicating drums 51 and 52 is about +250 to 500 V. This surface potential is set at an optimum value according to the charged state of the toner and environmental temperature and humidity. The environmental temperature and humidity can be easily known by detecting the resistance of the material having a characteristic of the resistance varying according to the environmental temperature and humidity. As described above, where the charged quantity of the toner is within a range of −20 to 35 μC/g and in the environment of room temperature and humidity, the surface potential of the first and second primary intermediate duplicating drums 51 and 52 is desirably about +380 V.

The first, second primary intermediate duplicating drum 51, 52 employed in this embodiment has e.g. an outer diameter of 42 mm and a resistance set at about 108 Ω. The first, second primary intermediate duplicating drum 51, 52 is a cylindrical rotary body composed of a single layer or plural layers and having a flexible or elastic surface. Generally, the cylindrical rotary body is a metallic pipe serving as a metallic core made of Fe or Al covered with a low resistance rubber layer (R=$10^2$ to $10^3$ Ω) such as a conductive silicon rubber having a thickness of about 0.1 to 10 mm. The outermost surface of the first, second primary intermediate drum 51, 52 is typically formed of a high releasability layer (R=$10^5$ to $10^9$ Ω) having a thickness of 3 to 100 μm and made of fluororubber dispersed with fluororesin particles and bonded by silane coupling agent adhesive (primer). The important matters are the resistance and the releasability of the surface. Any material may be employed as long as it provides the resistance of $R=10^5$ to $10^9$ Ω and high releasability of the releasability layer.

In this way, the monochromatic or double-color toner image created on the first, second primary intermediate duplicating drum 51, 52 is secondarily electrostatic-duplicated on the secondary intermediate duplicating drum 53. Thus, the final toner image from a monochromatic image to a fourfold-color image of yellow (Y), magenta (M), cyan (C) and black (K) is created on the secondary intermediate duplicating drum 53.

The surface potential required to duplicate electrostatically the toner image from the first, second intermediate photoconductor drum 51, 52 to the secondary duplicating drum 53 is about +600 to 1200 V. Like the case of duplication from the photoconductor drum 11, 12, 13, 14 to the first primary duplicating drum 51 and second primary duplicating drum 52, this surface potential is set at an optimum value according to the charged state of the toner and environmental temperature and humidity. Since what is necessary for duplication is the potential difference between the first, second primary intermediate duplicating drum 51, 52 and the secondary intermediate duplicating drum 53, the surface potential must be set at a value corresponding to the surface potential of the first, second primary intermediate duplicating drum 51, 52. As described above, where the charged quantity of the toner is within a range of −20 to 35 μC/g, in the environment of room temperature and humidity and where the surface potential of the first, second primary intermediate duplicating drum 51, 52 is about +380 V, the surface of the secondary intermediate duplicating drum 53 is desirably set at about +880 V, namely, the potential difference between the first, second primary duplicating drum 51, 52 and the secondary intermediate duplicating drum 53 is desirably set at about +500 V.

The secondary intermediate duplicating drum 53 employed in this embodiment has e.g. an outer diameter of 42 mm which is equal to that of the first, second primary intermediate duplicating drum 51, 52 and a resistance set at about $10^{11}$ Ω. Like the first, second primary intermediate duplicating drum 51, 52, the secondary intermediate duplicating drum 53 is also a cylindrical rotary body composed of a single layer or plural layers and having a flexible or elastic surface. Generally, the cylindrical rotary body is a metallic pipe serving as a metallic core made of Fe or Al covered with a low resistance rubber layer ($R=10^2$ to $10^3$ Ω) such as a conductive silicon rubber having a thickness of about 0.1 to 10 mm. The outermost surface of the secondary intermediate duplicating drum 53 is typically formed of a high releasability layer having a thickness of 3 to 100 μm and made of fluororubber dispersed with fluororesin particles and bonded by silane coupling agent adhesive (primer). Now, it should be noted that the resistance of the secondary intermediate duplicating drum 53 must be set at a higher value than that of the first, second primary intermediate duplicating drum 51, 52. If not, the secondary intermediate duplicating drum 53 charges the first, second primary intermediate duplicating drum 51, 52. This makes it difficult to control the surface potential of the primary intermediate duplicating drum 51, 52. As long as such a condition is satisfied, the secondary intermediate duplicating drum 53 may be made of any material.

Next, the final toner image from a monochromatic image to a fourfold-color image created on the secondary intermediate duplicating drum 53 is tertiarily electrostatic-duplicated on a duplicating sheet of paper P passing a sheet transfer path by a final duplicating roll 60. The duplicating sheet of paper P is passed through resisting rollers 61 via a paper feeding step as shown in FIG. 3, and sent in a nipping portion between the secondary intermediate duplicating drum 53 and the duplicating roll 60. After this final duplicating step, the final toner image created on the duplicating sheet of paper is fixed by heat and pressure by a fixing device 06. Thus, a series of imaging steps are completed.

The duplicating roll 60 has e.g. an outer diameter of 20 mm and a resistance set at about $10^8$ Ω. The duplicating roll 60 is formed of a metallic shaft covered with a semiconductive layer of e.g. urethane rubber and further covered with a tube having a surface microhardness larger than that of polyimide resin or polyetherimide resin. Concretely, the tube 63 may be made of polyimide resin or polyetherimide resin. The voltage to be applied to the duplicating roll 60 has an optimum value, which varies according to the environmental temperature and humidity, kind of sheet of paper (resistance and others), etc., and is generally about +1200 to 5000 V. This embodiment adopts a constant current system in which a substantially appropriate duplicating voltage (+1600 to 2000 V) can be obtained by passing a current of about +6 μA in an environment of room temperature and humidity.

Meanwhile, according to a first aspect of the invention, a sheet supplying/feeding device includes a sheet placing plate that places at least a tip of a sheet, a feeding unit that feeds the sheet while being in contact with the sheet placed on the sheet placing plate, and a driving unit that drives the feeding unit. Preferably, cam members are provided at both ends of a rotating shaft of the feeding unit, displacement changing members are swingably provided in engagement with the cam members, the sheet placing plate is shifted synchronously with the swing of the displacement changing members through first elastic members, and the sheet placed on the sheet placing plate and the feeding unit are contacted and separated by the synchronous movement.

According to a second aspect of the invention, the sheet supplying/feeding device is characterized in that contact points of the displacement changing members with the cam members move with rotation of the cam members.

In accordance with the invention, since the contact points of the displacement changing members with the cam members are shifted, interference between the cam members and the displacement changing members when the cam members are rotated is prevented, and the cam members and the displacement changing members can be arranged in vicinity of each other. This permits the sheet supplying/feeding device to be designed in a compact structure and in a shape advantageous in view of strength. Such a structure is resistant to abrasion of the displacement changing members, thus improving the endurance of the device.

According to a third aspect of the invention, the sheet supplying/feeding device further includes a restricting unit that restricts the swing of the displacement changing members so that the displacement changing members do not contact with the cam members in a stand-by state of the device.

In accordance with the invention, when the feeding unit starts to rotate, the displacement changing members are not in contact with the cam members. Therefore, the load relative to the urging force for the sheet placing plate does not act on the rotating shaft of the feeding unit so that the rotating load for the rotating shaft of the feeding unit is decreased. Thus, the rotating shaft rotates smoothly to realize a stabilized feeding operation.

According to a fourth aspect of the invention, the sheet supplying/feeding device further includes a tooth-lack gear that intermittently transmits a rotary driving force to the rotating shaft of the feeding unit as a unit that intermittently drives the feeding unit. Preferably, the displacement changing members do not contact with the cam members until the tooth-lack gear meshes with an idler gear on a driving side.

In accordance with the invention, when the feeding unit starts to rotate, the displacement changing members do not come in contact with the cam members until the tooth-lack gear meshes with the idler gear. This permits the force of the elastic member of the tooth-lack gear to be reduced, thereby implementing the stabilized feeding operation with no occurrence of inconveniences that the rotating shaft does not rotate, or continues to rotate. Further, the solenoid for intermittently rotating the tooth-lack gear can be downsized and operating sound of the solenoid can be reduced.

According to a fifth aspect of the invention, the sheet supplying/feeding device further includes second elastic members that urge the sheet placing plate in a direction of separating the sheet placing plate from the feeding unit.

In accordance with the invention, the force of separating the sheet placing plate from the feeding roller includes the weight of the sheet and the sheet placing plate and the restoring force of the urging unit. Therefore, according to the initial length of the urging unit and the influence of friction occurring among the respective components, as the case may be, it is difficult to restore the sheet placing plate to a predetermined position. Since the second elastic members are added to urge the sheet supplying/feeding in the direction of separating the sheet placing plate from the feeding unit, the sheet placing plate can be surely restored to the predetermined position.

According to a sixth aspect of the invention, the sheet supplying/feeding device is characterized in that the sheet placing plate, at least one of the displacement changing members and the first elastic members are made of a conductive material.

According to a sixth aspect of the invention, the sheet supplying/feeding device is characterized in that the sheet placing plate and at least one of the second elastic members are made of a conductive material.

In accordance with the inventions, static electricity can be discharged without separately providing a grounding plate or grounding wire.

Namely, the above sheet supplying/feeding device 70 is employed as a feeder for a hand tray 71 openably mounted on the printer body 01 as shown in FIG. 2. The sheet supplying/feeding unit 70, as seen from FIG. 1, is provided with a sheet placing plate 72 for placing a tip of the sheet, and a hand tray 71 for placing the rear end of the sheet at the read end of the sheet placing plate 72. The hand tray 71 is openably attached to the side of the printer body 01. During paper feeding, the hand tray 71 is opened and a sheet placed on the hand tray 71 and sheet placing plate 72 is fed. The hand tray 71 is structured so that the sheet is placed on the hand tray 71 with reference to the center in the width direction of the hand tray 71. Side guides 73 for holding both ends in the width direction of the sheet are slidably attached to the hand tray 71. The sheet placing plate 72 is made of a metallic plate or a conductive material such as plastic having conductivity. Incidentally, the hand tray 71 may be configured so that the sheet is placed thereon with reference to the one end in the width direction of the sheet, and fed.

Figure 4:
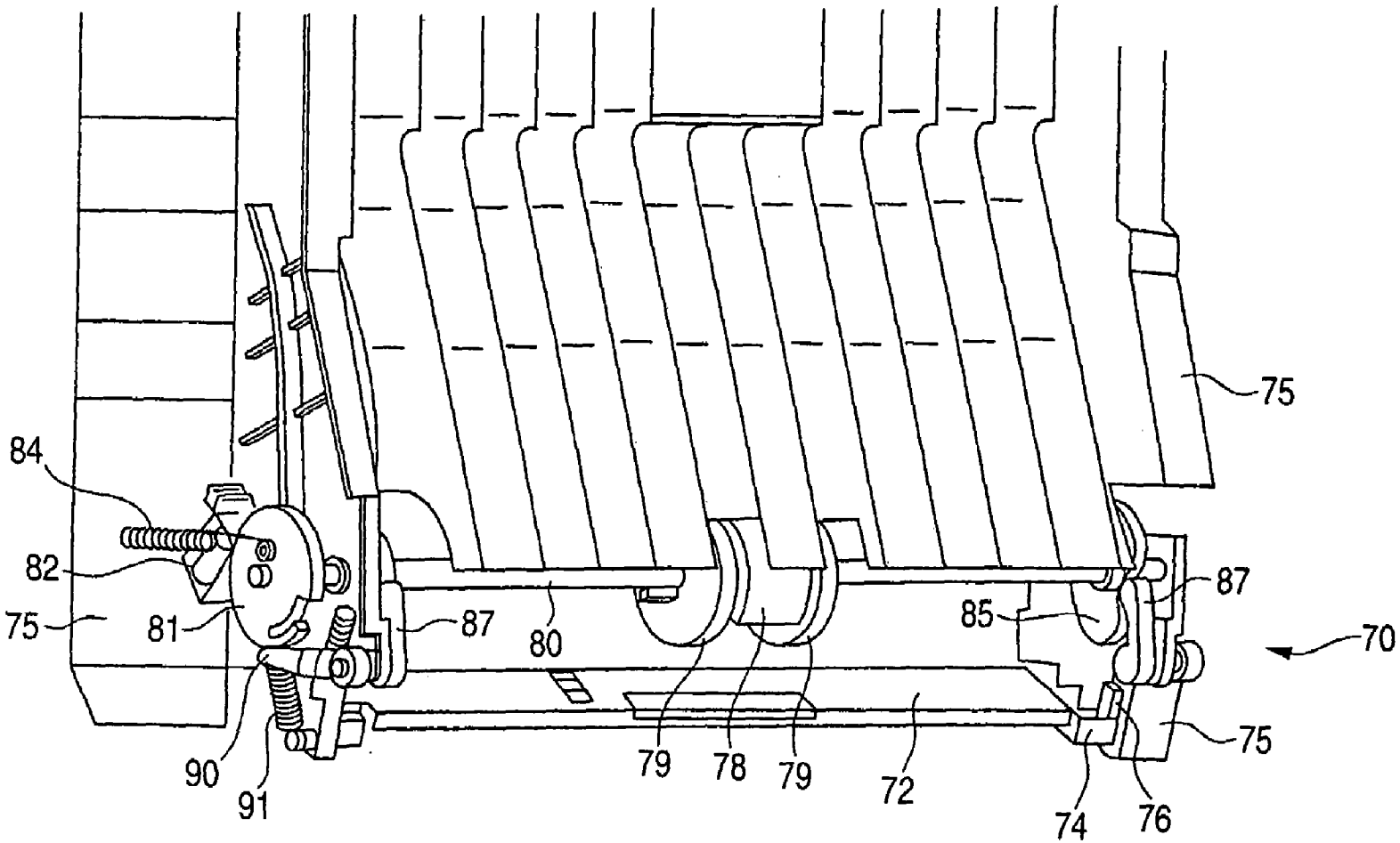
FIG. 4 is a perspective view showing a sheet supplying/feeding device according to the first embodiment of this invention.

From both ends of the sheet placing plate 72, as seen from FIG. 4, two sliding plates 74 are projected apart from each other by a prescribed distance. The sliding plates 74 are fit in longitudinal grooves 76 and 76 formed in an internal frame 75 of the printer body 01, so that they are mounted vertically movable in an approximately horizontally held state. To both ends of the sheet placing plate 72, as seen from FIG. 1, coil springs 77 are attached between sheet placing plate 72 and the frame of the printer body 01. The coil springs 77 serves as a second elastic member for urging the sheet placing plate 72 downward.

Further, above the sheet placing plate 72, as shown in FIG. 1, a crescent feeding roller 78 serving as a feeding unit is arranged. At both ends in an axial direction of the feeding roller 78, auxiliary rollers 79 having a slightly smaller diameter than that of the feeding roller 78 are provided in order to determine the uppermost position of the sheet. The surface of the feeding roller 78 is made of e.g. a rubber material having a high friction coefficient. The feeding roller 78 is fixedly attached to a rotating shaft 80 arranged above the sheet placing plate 72. To one end of the rotating shaft 80, a driving gear 81 is attached. The driving gear 81 serves as a driving unit for intermittently rotating the feeding roller 78. Incidentally, the auxiliary rollers 79 are rotatably attached to the rotating shaft 80.

Figure 5A:
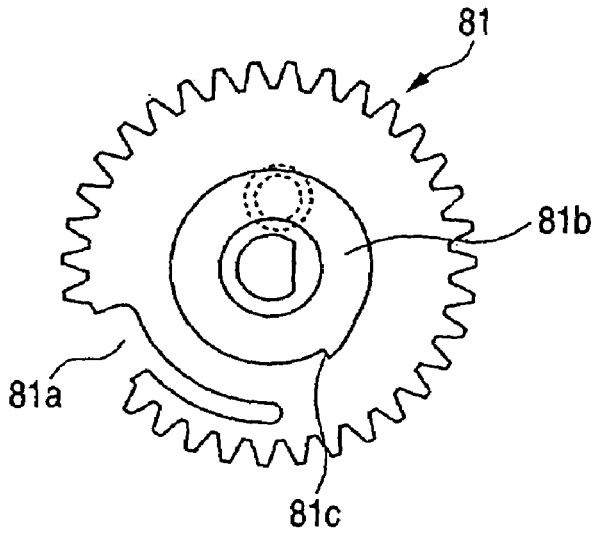
FIGS. 5A and 5B are views showing the structure of a tooth-lack gear.
Figure 5B:
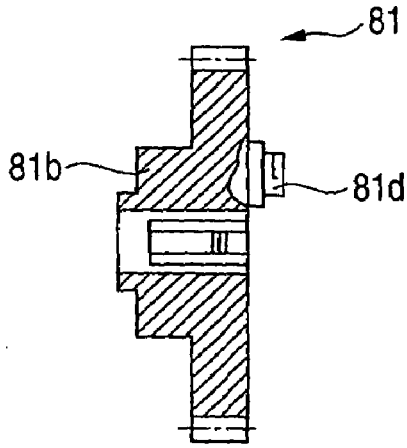

The driving gear 81, as seen from FIG. 5, constitutes a tooth-lack gear which is partially lack of a gear tooth at a portion 81*a* in order to intermittently rotate the feeding roller 78. The tooth-lack gear 81, which meshes with a gear on the side of a driving source (not shown), is rotated by the gear on the side of the driving source. However, since the tooth-lack gear 81 has the tooth-lack portion 81*a*, when the tooth-lack portion 81*a* of the tooth-lack gear 81 faces the gear on the side of the driving source, the rotating force is not transmitted from the gear of the side of the driving source so that the rotating shaft 80 stops. On the outer periphery of the tooth-lack gear 81, as seen from FIGS. 4 and 6, a solenoid 82 is arranged. An operating rod 83 of the solenoid 82, as seen from FIGS. 5 and 7, is secured to a securing portion 81*c* of a flange 81*b* formed on the one side of the tooth-lack gear 81. Further, on the other side of the tooth-lack gear 81, a securing portion 81*d* is provided. To this securing portion 81*d*, the one end of a coil spring 84 is secured which urges the tooth-lack gear 81 in a prescribed direction to rotate the tooth-lack gear 81. The other end of the coil spring 84 is secured to the frame 75 of the printer body 01.

When the solenoid 82 falls in an ON state so that the operating rod 83 of the solenoid 82 is released from the securing portion 81*c* of the tooth-lack gear 81, the tooth-lack gear 81 is urged in a direction of arrow by the coil spring 84 attached to the side of the tooth-lack gear 81 so that it is rotated. Then, the tooth-lack gear 81 meshes with the gear on the side of the driving source to transmit rotating force so that the rotating shaft 80 is rotated. When the tooth-lack gear 81 is further rotated, the tooth-lack portion 81*a* of the tooth-lack gear 81 faces the gear on the side of the driving source so that the rotating force ceases to be transmitted and the securing portion 81*c* of the flange 81*b* provided on the one side of the tooth-lack gear 81 meshes with the operating rod 83 of the solenoid 82. Thus, the tooth-lack gear 81 stops rotating.

To both ends of the rotating shaft 80, as seen from FIG. 1, the cam members 85 are fixedly attached. The lever members 86 are swingably engaged with the cam members 85.

Figure 8A:
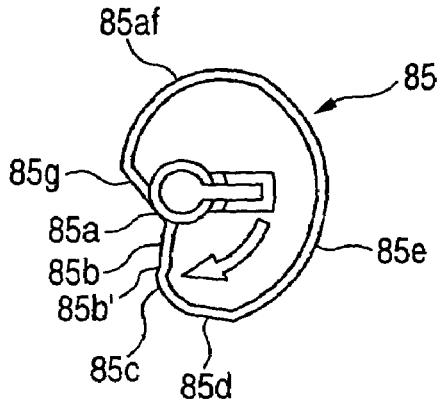
FIGS. 8A and 8B are views showing the structure of a cam member.
Figure 8B:
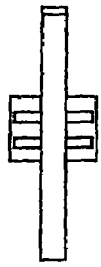

At least one of the lever members 86 is made of a conductive material such as a plastic imparted with conductivity, and as seen from FIG. 4, is swingably attached to the frame 75 of the printer body 01. The cam members 85, as seen from FIG. 8, include a first inclining zone 85*b* which inclines from a small-diameter zone 85*a* having the smallest outer diameter toward the outside in a radial direction, a second inclining zone 85*c* which inclines shortly toward the outer periphery of the first inclining zone 85*b*, a first curve zone 85*d* which curves so as to increase the diameter gradually from the outer peripheral edge of the second inclining zone 85*c*, an arc zone 85*e* which extends over a prescribed angle from the first curve zone 85*d*, a third curve zone 85*f* which curves to decrease the diameter gradually from the end of the arc zone 85*e*, and a third inclining zone 85*g* which inclines linearly from the third curve zone 85*f* toward the inner periphery.

Figure 9:
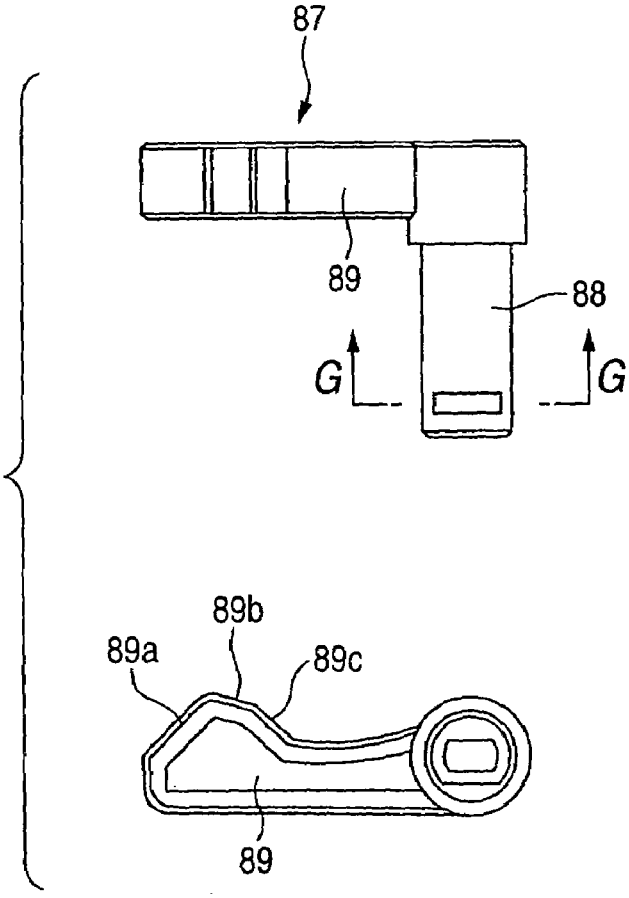
FIG. 9 is a view showing the structure of a cam follower of a lever member.
Figure 10A:
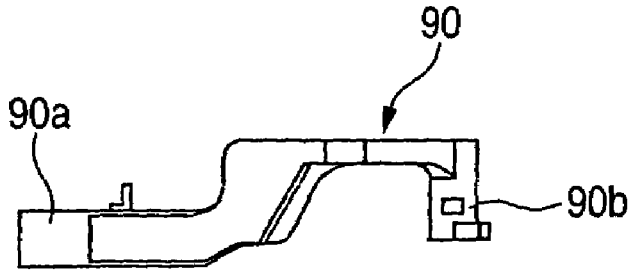
FIGS. 10A to 10D are views showing the structure of an arm of a lever member.
Figure 10B:
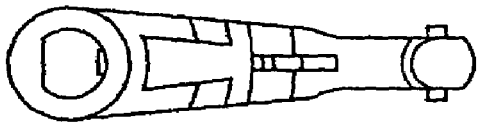
Figure 10C:
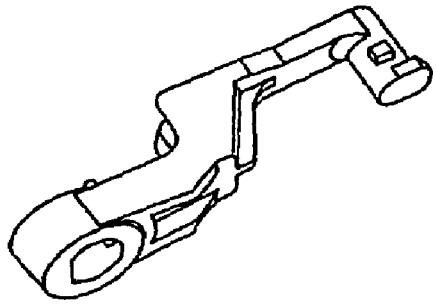
Figure 10D:
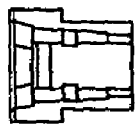

As seen from FIG. 1, cam followers 87 of the lever members 86 are arranged in contact with the surface of the cam members 85. The lever members 86 include the cam followers 87 and arms described later. The shaft member 88 (shown in FIG. 9) provided at the base of the cam followers 87, as seen from FIG. 4, is swingably attached to the frame 75 of the printer body 01. The cam followers 87, as seen from FIG. 9, are integrally projected from the tip of the shaft member 88 in the radial direction. The contact portions 89 of the cam followers 87 in contact with the cam members 85 includes a first inclining zone 89*a* which inclines at an angle of about 45° with respect to a center line C set horizontally from the tip side, a second inclining zone 89*b* which inclines by an angle of −20° toward the center line C from the first inclining zone 89*a*, and a third inclining zone 89*c* which inclines by an angle of −45° toward the center line C from the second inclining zone 89*b*. The cam followers 87 of the lever members 86 are structured such that their points in contact with cam members 85 move as the cam members 85 rotate so that the lever members 86 can be arranged in the vicinity of the cam members 85.

Further, as seen from FIG. 1, cam members 85 are provided with arms 90 fixedly attached to shaft members 77 on the opposite sides to the cam followers 87 with respect to the shaft members 88. As seen from FIG. 1, the arms 90 and the cam followers 87 are located to form a prescribed angle of about 45° therebetween. Coil springs 91 are located between the tips of the arms 90 and the sheet placing plate 72. The coil springs 91 serve as one of first elastic members at least one of which is made of a conductive material so as to correspond to the lever members 86. Thus, the sheet placing plate 72 shifts up and down through the coil springs 91 so as to follow the swing of the arms 90 so that the sheet placed on the sheet placing plate 72 comes in contact with or is separated from the feeding roller 78. The arms 90, as seen from FIG. 1, are structured such that the bases 90*a* are attached to the shaft members 88 and the tips are fixedly engaged to the end of the coil springs 91. Incidentally, the sheet placing plate 72 is permitted to discharge static electricity through the coil springs 91 and lever members 86. In order to accomplish that, coil springs 91 and lever members 86 are made conductive, static electricity may be also discharged through coil springs 77. Specifically, at least one of the coil springs 77 may be formed of a thin linear steel material so that static electricity from the sheet placing plate 72 is discharged externally through the coil springs 77.

Further, at both ends of the sheet placing plate 72, as seen from FIG. 1, a restricting member 92 for restricting the swing of lever members 86 is provided in contact with lever members 86. This prevents the lever members 86 from swinging inadvertently and coming into contact with cam members 85.

In the configuration described hitherto, as described later, the sheet supplying/feeding device according to this embodiment can supply/feed a sheet stably and intermittently while preventing an adverse effect and occurrence of impact sound due to shock during supplying/feeding of the sheet, without giving rise to upsizing components and complication of the structure.

Specifically, in the aforementioned sheet supplying/feeding device 70, as seen from FIGS. 1 and 4, during use, with the hand tray 71 being opened from the side of the printer body 01, a desired sheet is placed on this hand tray 71 and the sheet placing plate 72 arranged at the tip of the hand tray 71.

Figure 11A:
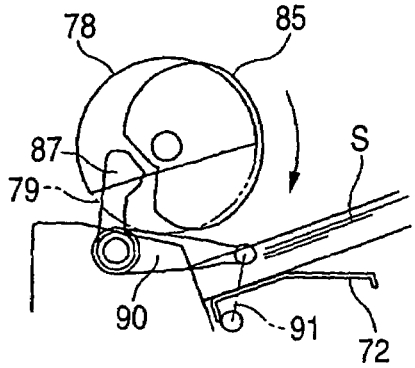
FIGS. 11A to 11E are views for explaining the operation of the sheet supplying/feeding device according to the first embodiment of this invention.

Meanwhile, in the case of the sheet supplying/feeding device 70, as seen from FIGS. 1 and 11A, in a non-feeding state, the small diameter zone 85*a* having the smallest outer diameter of the cam members 85 faces the tip of the cam followers 87 so that the cam members 85 and the cam followers 87 are separated from each other. Incidentally, in this state, the coil springs 91 are in a contracted state so that the sheet placing plate 72 is in a lowered state.

Figure 6:
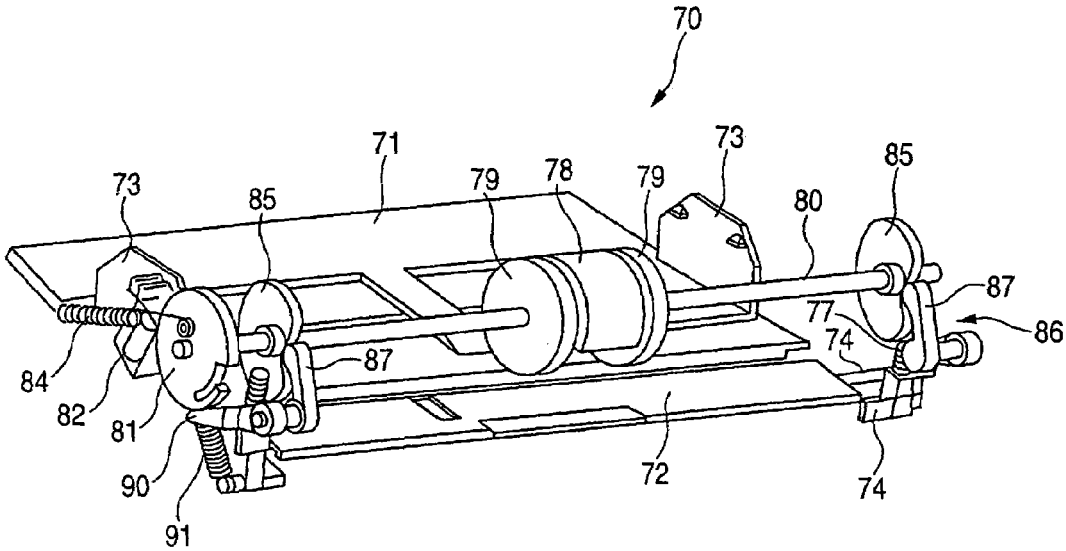
FIG. 6 is a perspective view showing a sheet supplying/feeding device according to the first embodiment of this invention.
Figure 7:
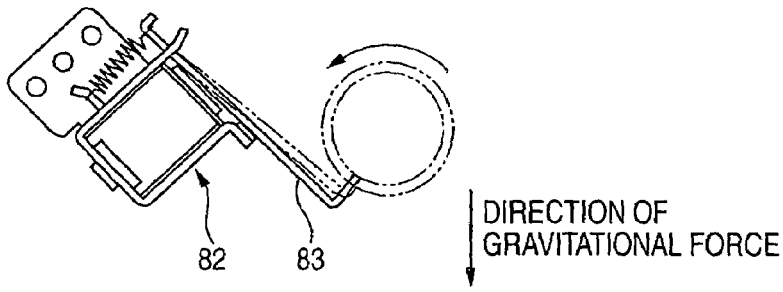
FIG. 7 is a view showing the structure of a solenoid.
Figure 11B:
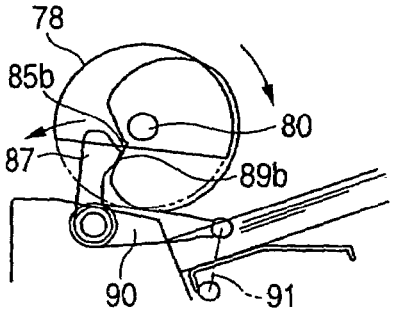

Next, in a feeding state, as seen from FIGS. 4 and 7, when the solenoid 82 is turned ON, the operating rod 83 of the solenoid 82 is disengaged from the engaging portion 81*c* of the tooth-lack gear 81 so that as seen from FIG. 6, the tooth-lack gear 81 is urged by the coil spring 84 to rotate. Thus, the tooth-lack gear 81 meshes with the gear on the side of the driving source so that it is rotated as shown in FIG. 11B. Then, the rotating shaft 80 to which the tooth-lack gear 81 is attached rotates in a clockwise direction as shown in FIG. 11B so that the cam members 85 attached to the rotating shaft 80 also rotates in the clockwise direction.

Thus, attendant on the rotation of the cam members 85, as seen from FIG. 11B, the second inclining zone 89*b* of the cam followers 87 comes in contact with the first inclining zone of the cam members 85 so that the cam followers 87 swings gradually in a counter-clockwise direction. The arms 90 integrally attached to the cam followers 87 also swing gradually in the counter-clockwise direction.

Figure 11C:
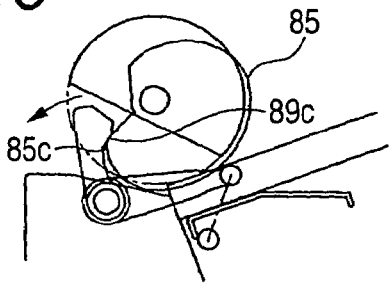

Thereafter, as seen from FIG. 11C, when the cam members 85 further rotates in the clockwise direction, the third inclining zone 89*c* of the cam followers 87 comes in contact with the second inclining zone 85*c* of the cam members 85 so that the cam followers 87 swings slightly in the counter-clockwise direction. The arms 90 integrally attached to the cam followers 87 also further swings in the counter-clockwise direction. As a result, the coil springs 91 located between the tip of the arms 90 and the sheet placing plate 72 extends gradually so that the sheet placing plate 72 shifts upwards owing to the extending force of the coil springs 91. The uppermost sheet S of the sheet placed on the sheet placing plate 72 comes in contact with the auxiliary roller 79, 79.

Figure 11D:
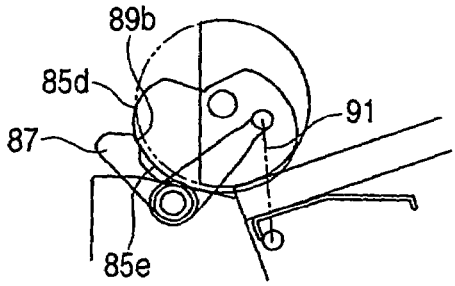
Figure 11E:
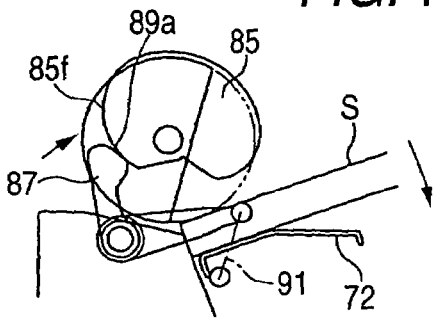
Figure 12:
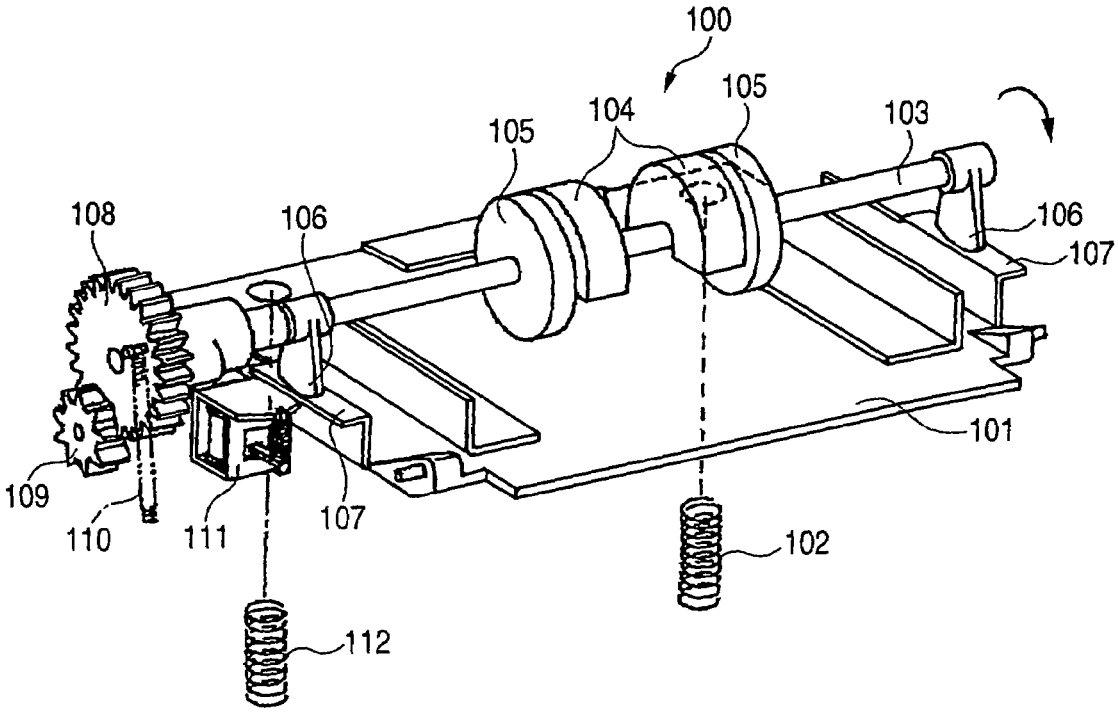
FIG. 12 RELATED ART
FIG. 12 is a view showing the structure of a conventional sheet supplying/feeding device.

Next, as seen from FIG. 11D, when the cam members 85 further rotates in the clockwise direction, the second inclining zone 89*b* of the cam followers 87 comes in contact with the first curve zone 85*d* and the arc zone 85*e* of the cam members 85 so that the cam followers 87 further swings largely in the counter-clockwise direction. The arms 90 integrally attached to the cam followers 87 also swing largely in the counter-clockwise direction. As a result, the coil springs 91 located between the tip of the arms 90 and the sheet placing plate 72 extends largely. Thus, with the sheet placing plate 72 shifted upwards owing to the extending force of the coil springs 91, the uppermost sheet S of the sheets placed on the sheet placing plate 7 is fed in contact with the feeding roller 78.

Thereafter, as seen from FIG. 1E, when the cam members 85 further rotates in the clockwise direction, the first inclining zone 89*a* of the cam followers 87 comes in contact with the third curve zone 85*f* of the cam members 85 so that the cam followers 87 now gradually rotates in the clockwise direction. The arms 90 integrally attached to the cam followers 87 also swing gradually in the clockwise direction. As a result, the coil springs 91 located between the tip of the arms 90 and the sheet placing plate 72 contracts. Attendant on the contraction of the coil springs 91, the sheet placing plate 72 shifts downwards so that the sheet S placed on the sheet placing plate 72 is separated from the feeding roller 78 and the auxiliary rollers 79.

As seen from FIGS. 1 and 11A, when the cam members 85 further rotates in the clockwise direction, the tooth-lack zone 81*a* of the tooth-gear 81 meshes with the gear on the side of the driving source so that rotation of the rotating shaft is stopped. Thus, the sheet placing plate 72 is stopped in a state shifted downward.

In this way, as shown in FIGS. 1 and 4 etc., in the sheet supplying/feeding device 70, cam members 85 attached to both ends of the rotating shaft 80 which rotates the feeding roller 78 rotates synchronously with the start of the rotation of the feeding roller 78, and the lever members 86 swing with the rotation of the cam members 85. Attendant on the lever members 86, the sheet placing plate 72 shifts upwards through the coil springs 91. As seen from FIGS. 11A to 11E, the urging force gradually increases with the extension of the coil springs 91 due to the swing of the lever members 86. Therefore, in such a simple configuration, the shock and impact sound at the instant when the sheet S touches with the feeding roller 78 can be relaxed. Further, since the sheet is urged at its both ends by the cam members 85 and the lever members 86 provided at both ends of the rotating shaft 80 which rotates the feeding unit, the sheet can be supplied/fed with a preferred supplying/feeding performance without being affected by the twist of the sheet placing plate 72. Since it is not necessary to arrange the urging member at the center of the sheet placing plate 72, the sheet supplying/feeding device can be provided in a compact structure.

Further, in the sheet supplying/feeding device described above, since the contact points of the lever members 86 with the cam members 85 are shifted, interference between the cam members 85 and the lever members 86 when the cam members 85 are rotated is prevented, and the cam members 85 and the lever members 86 can be arranged in vicinity of each other. This permits the sheet supplying/feeding device to be designed in a compact structure and in a shape advantageous in view of strength. Such a structure is resistant to abrasion of the lever members 86, thus improving the endurance of the device.

In the sheet supplying/feeding device 70, the restricting members for the restricting the swing of the lever members 86 are provided in order that in a stand-by state of the device, the lever members 86 do not come in contact with the lever members 85. For this reason, when the feeding roller 78 starts to rotate, the lever members 86 are not in contact with the cam members 85. Therefore, the load relative to the urging force for the sheet placing plate does not act on the rotating shaft 80 of the feeding roller 78 so that the rotating load for the rotating shaft 80 of the feeding roller 78 is decreased. Thus, the rotating shaft 80 rotates smoothly to realize a stabilized feeding operation.

Further, in the sheet supplying/feeding device 70, as an intermittent driving unit for the feeding roller 78, the tooth-lack gear 81 which transmits rotary driving force to the rotating shaft 80 of the feeding unit is employed so that the lever members 86 do not come in contact with the cam members 85 until the tooth-lack gear 81 meshes with an idler gear on the side of the driving source. Therefore, when the feeding roller 78 starts to rotate, the lever members 86 do not come in contact with the cam members 85 until the tooth-lack gear 81 meshes with the idler gear. This permits the force of the coil spring 84 of the tooth-lack gear 81 to be reduced, thereby implementing the stabilized feeding operation with no occurrence of inconveniences that the rotating shaft 80 does not rotate, or continues to rotate. Further, the solenoid 82 for intermittently rotating the tooth-lack gear 81 can be downsized and operating sound of the solenoid can be reduced.

Further, in the sheet supplying/feeding device 70, the coil springs 77 are provided to urge the sheet placing plate 72 in a direction of separating the sheet placing plate 72 from the feeding roller 78. The force of separating the sheet placing plate 72 from the feeding roller 78 includes the weight of the sheet S and the sheet placing plate 72 and the restoring force of the coil springs 91. Therefore, according to the initial length of the coil springs 91 and the influence of friction occurring among the respective components, as the case may be, it is difficult to restore the sheet placing plate 72 to a predetermined position. Since the coil springs 77 are added to urge the sheet supplying/feeding in the direction of separating the sheet placing plate from the feeding roller 78, the sheet placing plate 72 can be surely restored to the predetermined position.

Further, in the sheet supplying/feeding device, the sheet placing plate 72 and at least one of the lever members 86 and coil springs 91 are formed of a conductive material, or otherwise the sheet placing plate 72 and at least one of the coil springs 77 are formed of the conductive material, static electricity can be discharged without separately providing a grounding plate or grounding wire. Only one of the above configurations for discharging static electricity is required.

Here, the sheet supplying/feeding device configured in FIG. 1 has been described, but the displacement changing member is not limited to a form of lever. Numerous modifications and other embodiments are within the scope of one of ordinary skill in the art, such that a link can be applied to achieve the function of displacement magnification, that the elastic member can serve as a lever member, or the like.

The entire disclosure of Japanese Patent Application No. 2003-395636 filed on Nov. 26, 2003 including specification, claims, drawings and abstract is incorporated herein by reference in this entirety.

What is claimed is:

1. A sheet supplying/feeding device comprising:

a sheet placing plate that receives at least a tip of a sheet;

a feeding unit that feeds the sheet while being in contact with the sheet placed on the sheet placing plate; and a driving unit that drives the feeding unit, wherein one cam member is provided at each end of a rotating shaft of the feeding unit;

displacement changing members are swingably provided in engagement with the cam members;

the sheet placing plate is shifted by a swing of the displacement changing members through first elastic members; and the sheet placed on the sheet placing plate and the feeding unit come into contact with each other and are separated by the synchronism by synchronous movement of the feeding unit and the sheet placing plate, each of the displacement changing members includes a first member and a second member, each first member comes into contact with and separates from the corresponding cam member as the corresponding cam member rotates, and each second member engages with the corresponding first elastic member.

2. The sheet supplying/feeding device according to claim 1, wherein contact points of the displacement changing members with the cam members move with rotation of the cam members.

3. The sheet supplying/feeding device according to claim 1 further comprising:

a restricting unit that restricts the swing of the displacement changing members so that the displacement changing members do not contact the cam members in a stand-by state of the device.

4. The sheet supplying/feeding device according to claim 2 further comprising:

a restricting unit that restricts the swing of the displacement changing members so that the displacement changing members do not contact the cam members in a stand-by state of the device.

5. The sheet supplying/feeding device according to claim 3 further comprising:

a tooth-lack gear that intermittently transmits a rotary driving force to the rotating shaft of the feeding unit to intermittently drive the feeding unit, wherein the displacement changing members do not come in contact with the cam members until the tooth-lack gear meshes with an idler gear on a driving side.

6. The sheet supplying/feeding device according to claim 4 further comprising:

a tooth-lack gear that intermittently transmits a rotary driving force to the rotating shaft of the feeding unit to intermittently drive the feeding unit, wherein the displacement changing members do not come in contact with the cam members until the tooth-lack gear meshes with an idler gear on a driving side.

7. The sheet supplying/feeding device according to claim 1 further comprising:

second elastic members that urge the sheet placing plate in a direction of separating the sheet placing plate from the feeding unit.

8. The sheet supplying/feeding device according to claim 1, wherein the sheet placing plate, at least one of the displacement changing members and the first elastic members are made of conductive material.

9. The sheet supplying/feeding device according to claim 5, wherein the sheet placing plate and at least one of the second elastic members are made of conductive material.

10. The sheet supplying/feeding device according to claim 1, wherein the first elastic members engage with the displacement changing members, respectively.

11. The sheet supplying/feeding device according to claim 1, wherein the first elastic members are springs.

12. A sheet supplying/feeding device comprising:

a sheet placing plate that receives at least a tip of a sheet;

a feeding unit that feeds the sheet while being in contact with the sheet placed on the sheet placing plate; and a driving unit that drives the feeding unit, wherein one cam member is provided at each end of a rotating shaft of the feeding unit;

displacement changing members are swingably provided in engagement with the cam members;

the sheet placing plate is shifted by a swing of the displacement changing members through first elastic members; and the sheet placed on the sheet placing plate and the feeding unit come into contact with each other and are separated by the synchronism by synchronous movement of the feeding unit and the sheet placing plate, and each of the displacement changing members includes a first member and a second member and the first members and the second members are connected to each other via shaft members, respectively.

13. The sheet supplying/feeding device according to claim 12, wherein contact points of the displacement changing members with the cam members move with rotation of the cam members.

14. The sheet supplying/feeding device according to claim 12 further comprising:

a restricting unit that restricts the swing of the displacement changing members so that the displacement changing members do not contact the cam members in a stand-by state of the device.

15. The sheet supplying/feeding device according to claim 13 further comprising:

a restricting unit that restricts the swing of the displacement changing members so that the displacement changing members do not contact the cam members in a stand-by state of the device.

16. The sheet supplying/feeding device according to claim 14 further comprising:

a tooth-lack gear that intermittently transmits a rotary driving force to the rotating shaft of the feeding unit to intermittently drive the feeding unit, wherein the displacement changing members do not come in contact with the cam members until the tooth-lack gear meshes with an idler gear on a driving side.

17. The sheet supplying/feeding device according to claim 15 further comprising:

a tooth-lack gear that intermittently transmits a rotary driving force to the rotating shaft of the feeding unit to intermittently drive the feeding unit, wherein the displacement changing members do not come in contact with the cam members until the tooth-lack gear meshes with an idler gear on a driving side.

18. The sheet supplying/feeding device according to claim 12 further comprising:

second elastic members that urge the sheet placing plate in a direction of separating the sheet placing plate from the feeding unit.

19. The sheet supplying/feeding device according to claim 12, wherein the sheet placing plate, at least one of the displacement changing members and the first elastic members are made of conductive material.

20. The sheet supplying/feeding device according to claim 16, wherein the sheet placing plate and at least one of the second elastic members are made of conductive material.

21. The sheet supplying/feeding device according to claim 12, wherein the first elastic members engage with the displacement changing members, respectively.

22. The sheet supplying/feeding device according to claim 12, wherein the first elastic members are springs.

* * * * *